US009812314B2

(12) United States Patent
Burmeister et al.

(10) Patent No.: US 9,812,314 B2
(45) Date of Patent: Nov. 7, 2017

(54) LAMP

(71) Applicant: EATON PROTECTION SYSTEMS IP GMBH & CO. KG, Shönefeld (DE)

(72) Inventors: Jens Burmeister, Eberbach (DE); Gerhard Schwarz, Schönbrunn (DE)

(73) Assignee: EATON PROTECTION SYSTEMS IP GMBH & CO. KG, Schonefeld (DE)

( * ) Notice: Subject to any disclaimer, the term of this patent is extended or adjusted under 35 U.S.C. 154(b) by 38 days.

(21) Appl. No.: 14/782,295

(22) PCT Filed: Apr. 4, 2014

(86) PCT No.: PCT/EP2014/000904

§ 371 (c)(1),
(2) Date: Oct. 2, 2015

(87) PCT Pub. No.: WO2014/161670

PCT Pub. Date: Oct. 9, 2014

(65) Prior Publication Data

US 2016/0027634 A1 Jan. 28, 2016

(30) Foreign Application Priority Data

Apr. 5, 2013 (DE) ..... 10 2013 005 942

(51) Int. Cl.

| | |
|---|---|
| ***H01J 65/04*** | (2006.01) |
| ***H01J 61/30*** | (2006.01) |
| ***F21V 7/00*** | (2006.01) |

(52) U.S. Cl.

CPC ..... *H01J 65/044* (2013.01); *F21V 7/00* (2013.01); *H01J 61/30* (2013.01)

(58) Field of Classification Search

CPC ..... H01J 65/044; H01J 61/30; F21V 11/02; F21V 11/06; H05K 9/0056

See application file for complete search history.

(56) References Cited

U.S. PATENT DOCUMENTS

| | | |
|---|---|---|
| 4,933,602 A | 6/1990 | Ono et al. |
| 6,621,195 B2 | 9/2003 | Fuji et al. |

(Continued)

FOREIGN PATENT DOCUMENTS

| | | |
|---|---|---|
| CN | 1350698 | 5/2002 |
| EP | 0035898 | 9/1981 |
| EP | 1414058 | 4/2004 |

(Continued)

OTHER PUBLICATIONS

The State Intellectual Property Office of People's Republic of China, Office Action issued in Chinese Patent Application No. 201480019958.3, dated Jul. 26, 2016, 4 pages.

(Continued)

*Primary Examiner* — Anh Mai
*Assistant Examiner* — Nathaniel Lee
(74) *Attorney, Agent, or Firm* — King & Spalding LLP

(57) ABSTRACT

The invention relates to a lamp (1) comprising a light source (2) that can be excited by microwaves to provide illumination and a housing (4) surrounding the light source, said housing having at least one light exit opening (5). The light exit opening (5) has associated therewith a grille structure (6) or a labyrinth structure (7) acting as a microwave shield.

11 Claims, 2 Drawing Sheets

(56) References Cited

U.S. PATENT DOCUMENTS

| | | | | |
|---|---|---|---|---|
| 2002/0030453 | A1* | 3/2002 | Kirkpatrick ..... | H01J 65/044 315/248 |
| 2002/0101191 | A1 | 8/2002 | Dolan et al. | |

FOREIGN PATENT DOCUMENTS

| | | | |
|---|---|---|---|
| JP | 2007194012 | | 8/2007 |
| KR | 10-2006-0129862 | | 12/2006 |
| KR | 20060129862 | A * | 12/2006 |
| WO | 9856213 | | 12/1998 |
| WO | 0070651 | | 11/2000 |

OTHER PUBLICATIONS

Translation of Chinese Office Action, The State Intellectual Property Office of Peoples Republic of China, Office Action issued in Chinese Patent Application No. 201480019958.3, 6 pages.
Machine Translation of CN1350698 via LexisNexis Total Patents, 19 pages.
Machine Translation of KR10-2006-0129862 via LexisNexis Total Patents, 7 pages.
Zuccatti, Stefano, International Search Report of International Application No. PCT/EP2014/000904, dated May 28, 2014, dated Jun. 13, 2014, 6 pages, European Patent Office.

* cited by examiner

LAMP

PRIORITY CLAIM

The present application is a national phase of and claims priority to International Application No. PCT/EP2014/000904 with an International filing date of Apr. 4, 2014 and which claims priority to German patent application no. 10 2013 005 942.9 filed Apr. 5, 2013. The foregoing applications are hereby incorporated herein by reference.

TECHNICAL FIELD

The present invention relates to a lamp comprising a light source that can be excited by microwaves to provide illumination. Such a lamp is also referred to as microwave lamp and corresponds to a specific type of gas discharge lamp.

BACKGROUND

The energy for exciting the luminescent material is supplied in the form of microwave radiation. Such a lamp normally comprises a quartz bulb filled with a low-pressure inert gas. The quartz bulb is coated with metal halide salts. The microwave radiation is provided by a microwave generator or a magnetron and produces a plasma by ionizing the respective inert gas filling.

This plasma causes the metal halide salt to evaporate and the plasma and the metal halide salt in combination cause an emission of light. In addition, the light spectrum emitted can be influenced by doping the coating.

In hitherto known lamps of this kind, light was coupled out e.g. via an optical fiber or the like.

This was especially done for allowing, during production of the plasma by the microwave radiation, an adequate EMC (electromagnetic compatibility) when the lamp was being installed. This means that respective electric or electromagnetic effects that may be produced in the case of the above-mentioned lamp, in particular due to the microwave radiation, are to be prevented from negatively influencing other technical devices or living beings.

It is the object of the present invention to dispense with such optical fibers or the like and to provide a possibility of coupling light directly out of a respective lamp housing in a cost-efficient and easy manner.

SUMMARY

According to the present invention, this object is achieved in that the respective light exit opening of the lamp housing has associated therewith a grille structure or a labyrinth structure acting as a microwave shield.

This structure prevents radiation other than the desired light from exiting the lamp housing.

Normally, the lamp housing is made of metal, so that a suitable microwave shield only has to be provided additionally in the area of the light exit opening.

Due to this microwave shield, an additional coupling-out of light from the lamp housing is not necessary. Instead, conventional units can be used within the lamp housing for diffracting the light and deflecting it in the direction of the light exit opening, and it is only in the area of the light exit opening that suitable shielding against microwave radiation is effected, especially with respect to EMC.

This kind of grille or labyrinth structure is easy to arrange and can be produced at a reasonable price. In particular, it can easily be adapted to the shape and the size of the light exit opening.

Normally, the light exit opening of a lamp housing of the type in question is closed by a light-transparent cover, such as a glass or quartz plate. In order to be able to easily arrange the respective grille or labyrinth structure in this connection, said grille or labyrinth structure may be arranged in the housing interior in front of the respective light-transparent cover, when seen in the light exit direction. Grille and labyrinth structures impede a passage of light radiation only to a minor extent, or not at all, while guaranteeing that microwaves are reliably shielded off.

According to a simple embodiment of a grille structure of the type in question, said grille structure is defined by a perforated grille panel, in particular a metal grille panel. Such a perforated grille panel is easy to produce, especially in the necessary size and shape.

In order to constitute only a small obstacle, especially as regards the exit of light, the grille structure may comprise an arrangement of holes in rows and columns.

It is imaginable that the shape and the size of the holes varies in the respective direction of said rows or of said columns. According to a simple embodiment, it is, however, also possible that all the holes have identical shapes and identical diameters and are in particular circular holes.

Normally, a microwave radiation of approx. 2.45 GHz is used, which is able to produce a plasma between the associated microwave antennas. For shielding off the respective microwave radiation, the size of the holes should be much smaller than the respective wavelength of the radiation. This means that the hole diameter would be much smaller than 12 cm, which corresponds to a wavelength of the microwave radiation of 2.45 GHz.

In the case of a grille panel having such a perforated structure, said grille panel is additionally configured as an edge filter or a blocking filter, so that larger wavelengths, in particular in the range of the microwave radiation used, can be shielded off reliably.

Analogously, the labyrinth structure may be configured as a labyrinth panel, in particular a metal panel, comprising a large number of labyrinth passages which extend at an oblique angle to the light exit direction. The walls of the labyrinth passages can be reflective for light radiation, so that such light radiation can exit through the labyrinth passages in the direction of the light exit opening. Simultaneously, the labyrinth passages are, in correspondence with the holes, configured such that they have a suitable diameter preventing the passage of microwave radiation.

According to a preferred embodiment, the labyrinth passages may have a length which varies and especially increases from a middle central axis in an outward direction.

In this connection, it will normally be of advantage when the middle central axis is an axis of symmetry for the labyrinth passages, i.e. that the labyrinth panel comprising respective labyrinth passages is configured symmetrically above and below this axis of symmetry.

It has already been stated that, according to the present invention, the lamp or lamp housing may, as for the rest, be designed in the same way as in the case of other gas discharge lamps. This means that the light source may e.g. have associated therewith a light reflection unit for deflecting light radiation, which is emitted by said light source, substantially in the direction of the light exit opening.

Such a light reflection unit may be configured as a parabolic mirror or the like.

A simple way of associating the grille or labyrinth panel with the light exit opening is an arrangement of the grille or labyrinth panel on a back of the light-transparent cover, said back facing the light source.

In addition, there is the possibility of arranging the grille and labyrinth panels such that they are exchangeable. It is not only possible to exchange respective grille panels among one another and respective labyrinth panels among one another, but an exchange of a grille panel for a labyrinth panel and vice versa is possible as well.

BRIEF DESCRIPTION OF THE DRAWINGS

In the following, advantageous embodiments of the present invention are explained in more detail making reference to the figures added in the drawing, in which.

DETAILED DESCRIPTION OF EXAMPLE EMBODIMENTS

Figure 1:
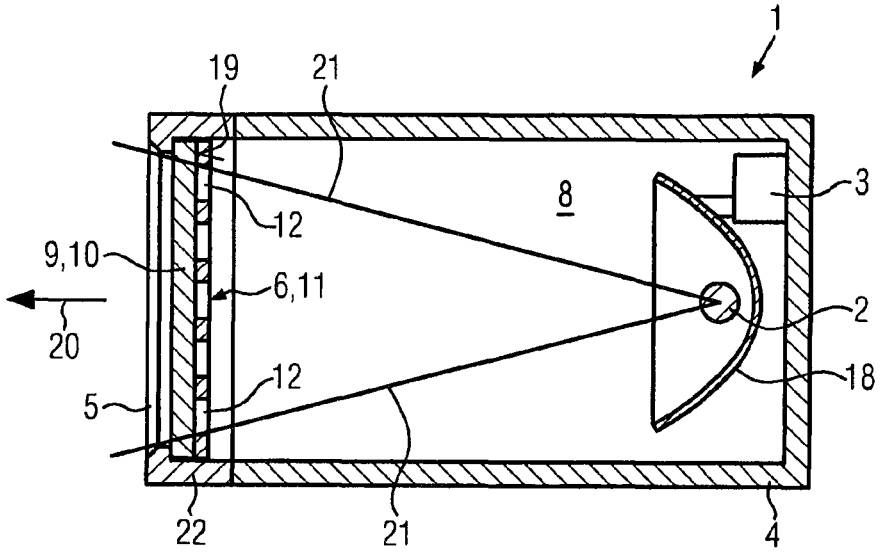
FIG. 1 shows a longitudinal section through an embodiment of a lamp according to the present invention.

FIG. 1 shows a longitudinal section through a first embodiment of a lamp 1 according to the present invention. This lamp 1 comprises a lamp housing 4, which is in principle rectangular in shape. Said lamp housing is only shown exemplarily and other shapes thereof are imaginable as well. The interior 8 of the housing has arranged therein a microwave generator 3 configured as a magnetron. This microwave generator feeds microwave energy to respective antennas arranged within the light source 2 comprising a suitable quartz bulb or the like. Between the antennas, a plasma is produced from a suitable inert gas by means of the microwave radiation, said plasma causing a metal halide salt applied to the glass or quartz bulb to evaporate and light in a respective spectral range being generated from the inert gas plasma and the metal halide salt vapor.

The light source 2 is partially surrounded by a light reflection unit 18 configured e.g. as a parabolic mirror. By means of this parabolic mirror, light emitted by the light source 2 is directed towards a light exit opening 5 of the lamp housing 4. The lamp housing 4 normally consists of a metal constituting a shield against the microwave radiation. The light exit opening 5 has associated therewith a grille structure 6 defining a suitable microwave shield in the area of the light exit opening. The grille structure 6 is arranged on a back 19 of a light-transparent cover 9 configured as a glass or quartz plate 10. The light-transparent cover 9 and the grille structure 6 are arranged in a releasable end section 22 of the lamp housing 4. The grille structure 6 is arranged in front of the light-transparent cover 9, when seen in the light exit direction 20, i.e. on the back 19 of said light-transparent cover 9 facing the light source 2.

The light exit opening is fully covered by the light-transparent cover 9, the respective grille structure 6 having analogous dimensions.

Furthermore, two light beams 21 are exemplarily shown in FIG. 1, said light beams corresponding substantially to the maximum exit angle of light radiation from the light exit opening 5 of the lamp housing 4.

The grille structure 6 is configured as a grille panel 11 comprising a plurality of holes 12. As can also be seen in FIGS. 2 and 3, these holes are arranged in rows and columns and have identical shapes and identical diameters.

The diameter of the respective holes 12 is much smaller in comparison with the wavelength of the microwave radiation, a microwave radiation suitable for use being e.g. a 2.45 GHz radiation having a wavelength of approx. 12 cm. The respective holes 12 obstruct exiting of the light beams 21 only to a minor extent, whereas the grille structure 6 defines a reliable microwave shield for the microwave radiation.

The grille panel 11 consists of a low-cost perforated metal plate, which is easy to produce and which can easily be adapted to respective sizes of the light exit opening and of the light-transparent cover 9. Like the labyrinth panels 13 referred to hereinbelow, this kind of grille panels 11 can be produced not only in the substantially square shape according to FIGS. 2, 3, 5 and 6, but also in the shape of almost any light exit opening with a suitable light-transparent cover 9.

Figure 2:
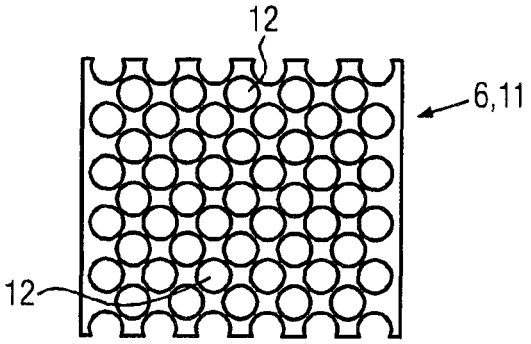
FIG. 2 shows a front view of a grille panel as a grille structure.
Figure 3:
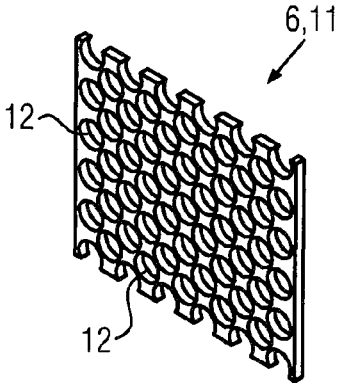
FIG. 3 shows a view at an oblique angle of the grille structure according to FIG. 2.

FIGS. 2 and 3 show the grille structure 6 in the form of the grille panel 11 in a front view and at an oblique angle from the front. What can especially be seen is the arrangement of the respective holes 12 in columns and rows. In the edge area, said holes 12 may also be formed only incompletely, cf. in FIG. 2 the holes along the upper and lower edges of the grille panel 11.

FIG. 3 shows the grille panel according to FIG. 2 at an oblique angle from the front. Also in this case the arrangement in columns and rows as well as the incomplete formation of holes 12 along upper edges of the respective grille panel can be seen.

Figure 4:
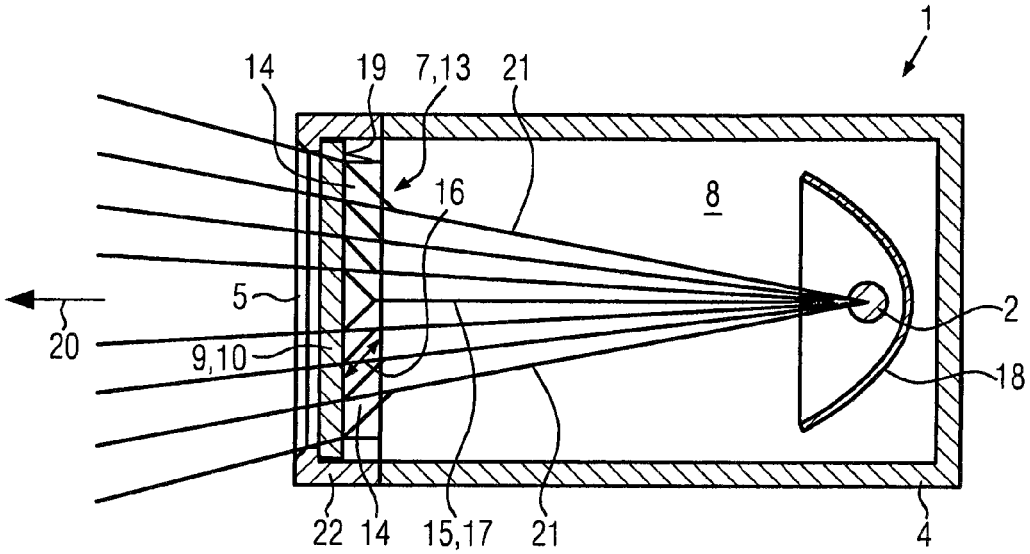
FIG. 4 shows a longitudinal section, analogously to FIG. 1, through a second embodiment of the present invention.

FIG. 4 shows a second embodiment of a lamp 1 according to the present invention. For the sake of simplicity, the microwave generator 3 is here not shown. The structural design of the lamp 1 corresponds to that of FIG. 1, the only difference being that a labyrinth structure 7 instead of the grille structure 6 is used as a microwave shield. As regards the further description of the lamp 1 according to FIG. 4, the description according to FIG. 1 is referred to.

In FIG. 4 a plurality of light beams 21 are shown, which pass through the labyrinth structure 7 in the form of a labyrinth panel 13. In order to allow this, the labyrinth panel 13 has a plurality of labyrinth passages 14. These labyrinth passages 14 extend outwards at an oblique angle relative to the light exit direction 20. Also the labyrinth panel 13 is arranged on the respective back 19 of the light-transparent cover 9 covering the light exit opening 5 of the lamp housing.

Figure 5:
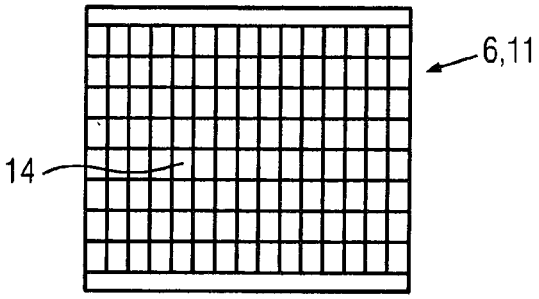
FIG. 5 shows a front view of a labyrinth panel as a labyrinth structure.

The respective labyrinth passages 14 have an approximately rectangular cross-section on the exit side of the labyrinth panel 13, cf. FIG. 5, while extending in the direction of the light source 2 at an oblique angle inwards towards a central axis 15. The length of the respective labyrinth passages 14 increases from the central axis 15 in an outward direction, cf. the exemplarily shown length 16 in FIG. 4. Furthermore, the labyrinth panel 13 provided with the respective labyrinth passages 14 is configured symmetrically with respect to a horizontal plane extending through the central axis 15 as an axis of symmetry 17, cf. FIGS. 4 to 6. This means that, in the upper area of the labyrinth panel 13 according to FIG. 4, the labyrinth passages 14 extend at an oblique angle upwards in the direction of the light exit opening 5, and that the corresponding labyrinth passages 14 in the lower part of the labyrinth panel 13 extend at an oblique angle downwards in the direction of the light exit opening 5.

The respective inner sides of the labyrinth passages 14 may be configured such that they reflect light beams so that the exiting of the light beams 21 from the light exit opening 5 will not be impeded to a substantial extent by said labyrinth passages. The size and the shape of the labyrinth passages 14 and in particular of the entrance openings thereof, which face the light source 2, are substantially analogous to the size and diameter of the holes 12 according to FIGS. 1 to 3.

Figure 6:
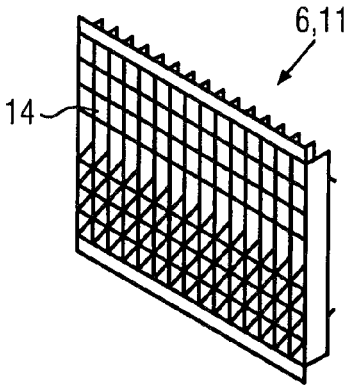
FIG. 6 shows a view at an oblique angle of the labyrinth structure according to FIG. 5.

FIGS. 5 and 6 show, in analogy with FIGS. 2 and 3, a front view and a perspective view at an oblique angle from the front showing the respective labyrinth panel 13. The labyrinth passages 14 are arranged in rows and columns directly adjacent to one another. The respective labyrinth panel 13 with its labyrinth passages 14 also consists of a metal having suitable microwave shielding characteristics.

According to the present invention, a reliable, simple and cost-efficient microwave shielding is obtained by means of the grille structure 6 or the labyrinth structure 7 associated directly with the light exit opening and the light-transparent cover 9 of said light exit opening 5, respectively. The respective openings provided in these structures are sufficiently small in size for preventing exiting of the microwave radiation. Whereas the perforated grille panel 11 also defines a blocking filter, the respective labyrinth panel 13 may also be regarded as a resonance seal. This means that the respective labyrinth passages define substantially rectangular waveguides, which are sufficiently small in comparison with the wavelength of the microwave radiation for preventing wave propagation along the labyrinth passages. A respective cutoff wavelength A is obtained e.g. according to the relationship $\lambda_c=2\times a$, where a is the longer side of the waveguide cross-section, cf. in this respect e.g. FIG. 5.

The respective cutoff wavelength should be sufficiently small in comparison with the wavelength of the microwave radiation to be shielded off.

In addition, it is possible to exchange the respective structures, cf. the grille structure 6 and the labyrinth structure 7, among one another as well as to exchange one for the other, so that a grille structure may e.g. also replace a labyrinth structure.

The invention claimed is:

1. A lamp comprising a light source that can be excited by microwaves to provide illumination and a housing surrounding the light source, said housing having at least one light exit opening, characterized in that the light exit opening has associated therewith a labyrinth structure acting as a microwave shield, said labyrinth structure being configured as a labyrinth panel comprising a plurality of labyrinth passages which extend at an oblique angle relative to the light exit direction, wherein light beams emitted by the light source travel through a housing interior, the labyrinth structure, and the light exit opening, wherein the plurality of labyrinth passages has a length that varies between the housing interior and the light exit opening.

2. The lamp according to claim 1, characterized in that the labyrinth structure is arranged in the housing interior in front of a light-transparent cover, when seen in the light exit direction, said light-transparent cover being in particular a glass or quartz plate.

3. The lamp according to claim 1, characterized in that the microwave shield is configured as an edge filter or a blocking filter.

4. The lamp according to claim 1, wherein the length of the plurality of labyrinth passages varies by increasing from a middle central axis in an outward direction toward the light exit opening.

5. The lamp according to claim 1, wherein the plurality of labyrinth passages has a middle central axis, wherein the middle central axis is an axis of symmetry for the plurality of labyrinth passages.

6. The lamp according to claim 1, characterized in that the light source has associated therewith a light reflection unit for deflecting light beams, which are emitted by said light source, substantially in the direction of the light exit opening.

7. The lamp according to claim 1, characterized in that the labyrinth panel is arranged on a back of the light-transparent cover, said back facing the light source.

8. The lamp according to claim 1, characterized in that the labyrinth panel is arranged such that it is exchangeable.

9. The lamp according to claim 1, wherein the plurality of labyrinth passages comprise at least one wall, wherein the at least one wall comprises a reflective material.

10. The lamp according to claim 9, wherein the plurality of labyrinth passages comprise at least one wall, wherein the at least one wall comprises metal.

11. The lamp according to claim 1, wherein the plurality of labyrinth passages comprise at least one wall, wherein the at least one wall has a diameter that substantially prevents passage of microwave radiation therethrough.

* * * * *